US009223267B2

(12) United States Patent
Kawajiri

(10) Patent No.: US 9,223,267 B2
(45) Date of Patent: Dec. 29, 2015

(54) IMAGE FORMING SYSTEM, CONTROL METHOD, AND PROGRAM

(71) Applicant: CANON KABUSHIKI KAISHA, Tokyo (JP)

(72) Inventor: Kensuke Kawajiri, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/659,407

(22) Filed: Mar. 16, 2015

(65) Prior Publication Data

US 2015/0268594 A1 Sep. 24, 2015

(30) Foreign Application Priority Data

Mar. 18, 2014 (JP) ..... 2014-055463

(51) Int. Cl.
*G03G 15/20* (2006.01)

(52) U.S. Cl.
CPC ..... *G03G 15/205* (2013.01)

(58) Field of Classification Search
CPC ..... G03G 15/1675; G03G 15/5029; G03G 15/205
See application file for complete search history.

(56) References Cited

FOREIGN PATENT DOCUMENTS

JP 2000-066536 A 3/2000
JP 2004-314308 A 11/2004

*Primary Examiner* — G. M. Hyder
(74) *Attorney, Agent, or Firm* — Canon U.S.A., Inc., IP Division

(57) ABSTRACT

An image forming system includes receiving units that receive sheet settings and a setting of a mode for reducing toner scattering, a first setting unit setting, according to received sheet settings, a conveyance speed of a sheet when performing an image forming process, a second setting unit setting, according to a received setting of a mode for reducing toner scattering, a transfer voltage of a recording material when performing an image forming process, and an image forming unit that performs an image forming process according to the received sheet setting, a set conveyance speed, and a set transfer voltage, wherein the second setting unit sets, when a mode for reducing toner scattering is received, a first transfer voltage when a first conveyance speed is set and a second transfer voltage, lower than the first transfer voltage, when a second conveyance speed is lower than the first conveyance speed.

15 Claims, 10 Drawing Sheets

IMAGE FORMING SYSTEM, CONTROL METHOD, AND PROGRAM

BACKGROUND

1. Field

Aspects of the present invention generally relate to an image forming system, a control method, and a program.

2. Description of the Related Art

When a printer does printing, the printer transfers toner to a sheet, heat-presses the toner using a fixing unit, and fixes the toner on the sheet.

In such a case, if a color solidly fills an image, moisture in the sheet rapidly evaporates while the sheet passes through the fixing unit. The toner positioned on an upstream side of the fixing unit is then partially blown off, so that an image failure referred to as tailing (i.e., toner scattering) occurs. To prevent such tailing, Japanese Patent Application Laid-Open No. 2004-314308 discusses a technique which performs thinning on raster data. Further, Japanese Patent Application Laid-Open No. 2000-066536 discusses a technique for preventing tailing (toner scattering) by setting a transfer voltage applied when transferring the toner to the sheet to a high voltage.

On the other hand, if a sheet type or a sheet size is special, the printer may perform printing by decreasing a conveyance speed of the sheet. For example, if the sheet type is cardboard, it is necessary to perform fixing for a long time, so that the conveyance speed is decreased. Further, if the sheet size is of a narrow width, temperature of edge portions of the fixing unit rise, so that the conveyance speed of the sheet is decreased.

The toner is transferred from a photosensitive member to the sheet as follows. The voltage of an opposite voltage as the toner is applied to a transfer member such as a transfer roller press-contacting or opposing the photosensitive member. An electric field is thus formed so that the toner is directed towards the transfer member. In such a case, a charge of opposite polarity to the toner is applied to the sheet, and the toner is held on the sheet in an electrostatic manner. In light of a holding power caused by static electricity, it is advantageous to apply a large amount of charge to the sheet so that the above-described tailing-blur does not easily occur. However, if the transfer voltage becomes excessively high, the charge overflows on the sheet and thus leaps over the sheet to reach the toner. The toner is thus charged to have the same polarity as the transfer voltage, and toner scattering and a transfer failure such as re-transfer occurs.

If the transfer voltage for transferring the toner to the sheet is set high to prevent tailing-blur, the transfer failure does not easily occur especially in the case where the conveyance speed of the sheet is low. More specifically, the amount of charge implanted in the sheet is determined by multiplying the transfer voltage by a passing time of the sheet. As a result, when the conveyance speed is low (i.e., the passing time is long), it becomes easier for the charge to overflow on the sheet even if the transfer voltage is the same.

SUMMARY

An aspect of the present invention is generally directed to preventing the transfer failure when setting a high voltage for transferring the toner to the sheet in order to reduce toner scattering, even in the case where the conveyance speed of the sheet is low.

According to an aspect of the present invention, an image forming system includes a first receiving unit configured to receive sheet settings, a second receiving unit configured to receive a setting of a mode for reducing toner scattering in a fixing unit, a first setting unit configured to set, according to sheet settings received by the first receiving unit, a conveyance speed of a sheet when performing an image forming process, a second setting unit configured to set, according to a setting of a mode for reducing toner scattering received by the second receiving unit, a transfer voltage of a recording material when performing an image forming process, and an image forming unit configured to perform an image forming process according to a sheet setting received by the first receiving unit, a conveyance speed set by the first setting unit and a transfer voltage set by the second setting unit, wherein the second setting unit sets, in the case where the second receiving unit has received a mode for reducing toner scattering, a first transfer voltage when the first setting unit sets a first conveyance speed, and a second transfer voltage that is lower than the first transfer voltage when the first setting unit sets a second conveyance speed that is lower than the first conveyance speed.

According to the present disclosure, when the method for setting the high transfer voltage for transferring the toner to the sheet to reduce toner scattering is employed, the transfer failure does not easily occur even in the case where the conveyance speed of the sheet is low.

Further features of the present disclosure will become apparent from the following description of exemplary embodiments with reference to the attached drawings.

DESCRIPTION OF THE EMBODIMENTS

A single function printer will be described below as an example of an image forming apparatus. However, the image forming apparatus may be a multifunction printer (i.e., a printer serving copy, scan, and facsimile functions in addition to a print function).

<The Image Forming System>

Figure 1:
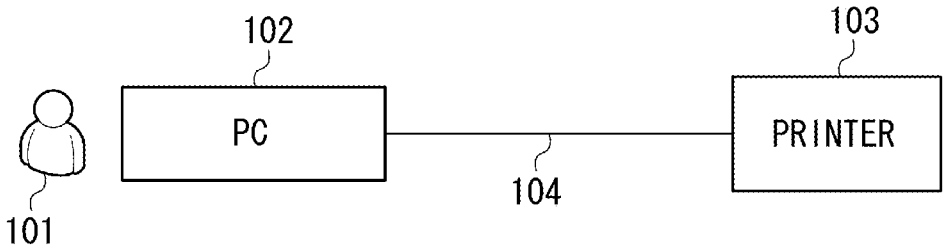
FIG. 1 illustrates a system configuration.

A first exemplary embodiment will be described below. FIG. 1 illustrates a system configuration.

Referring to FIG. 1, when a user 101 issues an instruction, a PC 102 transmits a print job to a printer 103. The PC 102 and the printer 103 are capable of communicating with each other via a network 104 (e.g., a universal system bus (USB), a wired local area network (LAN), or a wireless LAN).

<The Configuration of the Apparatus: The PC (an Information Processing Apparatus)

Figure 2:
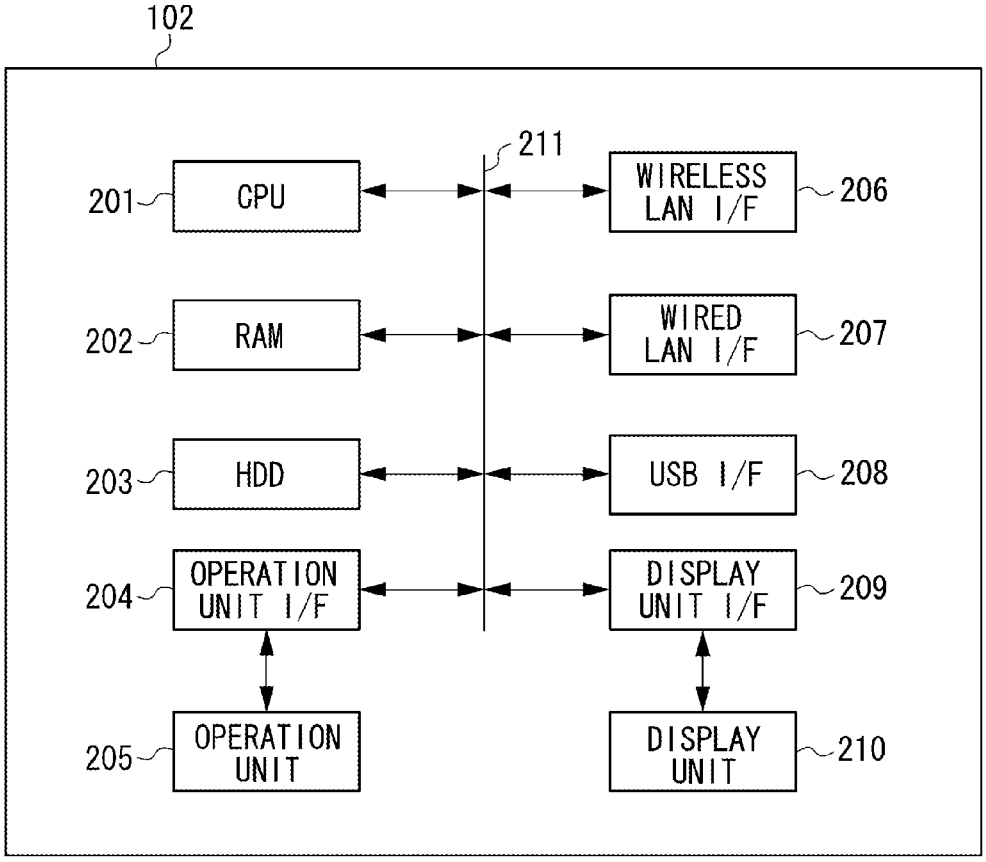
FIG. 2 is a block diagram illustrating a configuration of a personal computer (PC).

FIG. 2 is a block diagram illustrating the configuration of the PC.

Referring to FIG. 2, a central processing unit (CPU) 201 controls the entire system of the PC 102.

A random access memory (RAM) 202 functions as a work memory of the CPU 201.

A hard disk drive (HDD) 203 stores the data and the programs to be used by the CPU 201.

An operation unit interface (I/F) 204 transmits and receives data to and from an operation unit 205.

The operation unit 205 receives various operations from the user.

A wireless LAN I/F 206 transmits and receives the data to and from the wireless LAN.

A wired LAN I/F 207 transmits and receives the data to and from the wired LAN.

A USB I/F 208 transmits and receives the data to and from the USB.

A display unit I/F 209 transmits and receives the data to and from a display unit 210.

The display unit 210 displays various types of information to the user.

A bus 211 connects each of components in the PC 102 with each other.

<The Configuration of the Apparatus: The Printer (i.e., the Image Forming Apparatus)>

Figure 3:
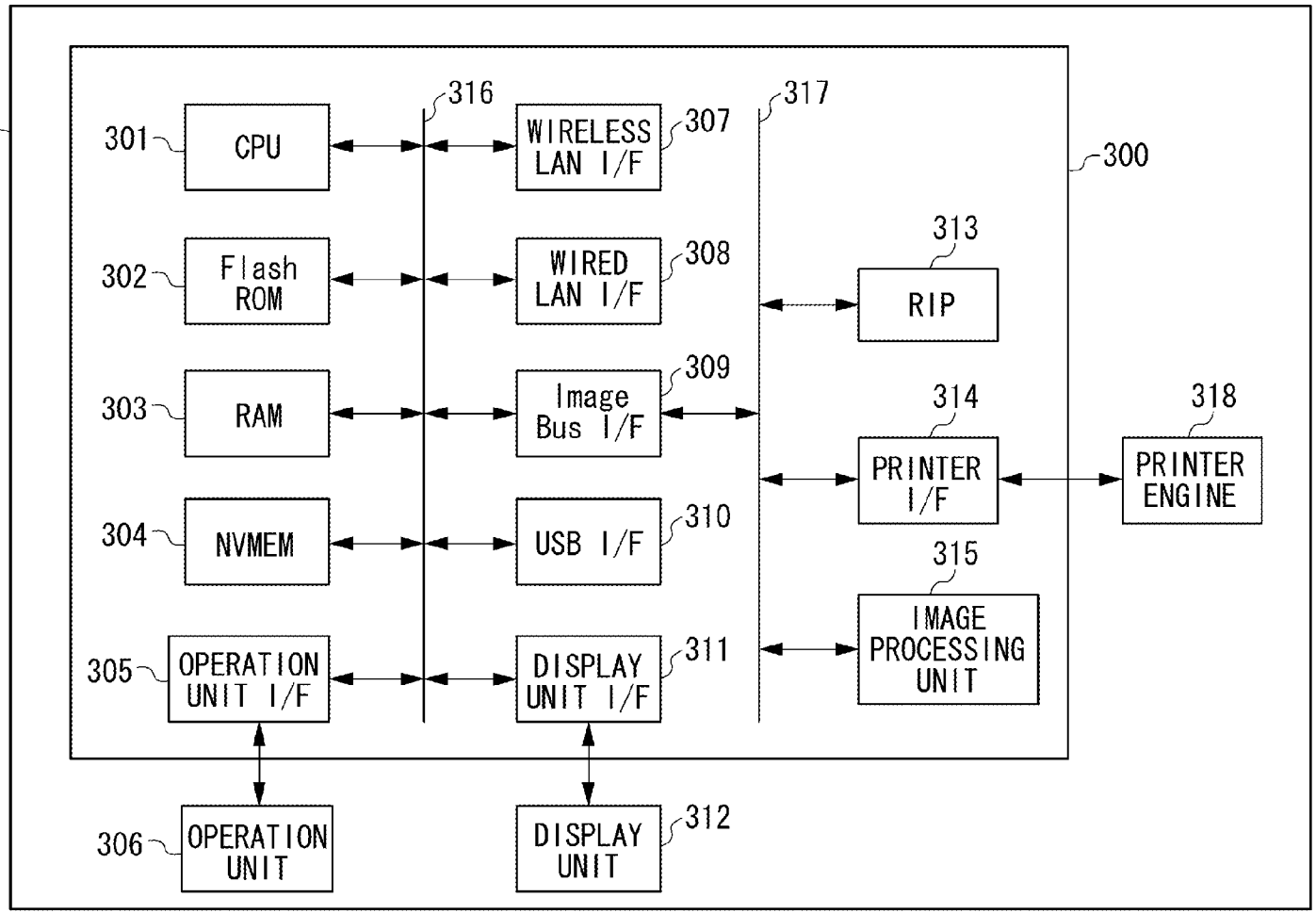
FIG. 3 is a block diagram illustrating a configuration of a printer.

FIG. 3 is a block diagram illustrating the configuration of the printer.

Referring to FIG. 3, a controller 300 includes various components necessary for controlling printing.

A CPU 301 controls the entire system of the printer 103.

A Flash read-only memory (ROM) 302 is a non-volatile rewritable storage medium which stores a control program to be used by the CPU 301.

A RAM 303 functions as the work memory of the CPU 301.

A non-volatile memory (NVMEM) 304 is a non-volatile storage medium which stores setting information and the like of the printer 103.

An operation unit I/F 305 transmits and receives data to and from an operation unit 306.

The operation unit 306 receives various operations from the user.

A wireless LAN I/F 307 transmits and receives the data to and from the wireless LAN.

A wired LAN I/F 308 transmits and receives the data to and from the wired LAN.

An image bus I/F 309 connects a system bus 316 and an image bus 317 with each other.

A USB I/F 310 transmits and receives the data to and from the USB.

A display unit I/F 311 transmits and receives the data to and from a display unit 312.

The display unit 312 displays various types of information to the user.

A raster image processor (RIP) 313 rasterizes page description language (PDL) data and generates the raster data (i.e., bitmap data).

A printer I/F 314 connects the image bus 317 and a printer engine 318 with each other.

An image processing unit 315 performs various types of image processing such as correction, processing, editing, rotation, compression, decompression, and resolution conversion.

The system bus 316 connects the components related to system control in the controller 300 with each other.

The image bus 317 connects the components related to image processing in the controller 300 with each other.

The printer engine 318 prints an image on the sheet based on the raster image data.

Figure 10:
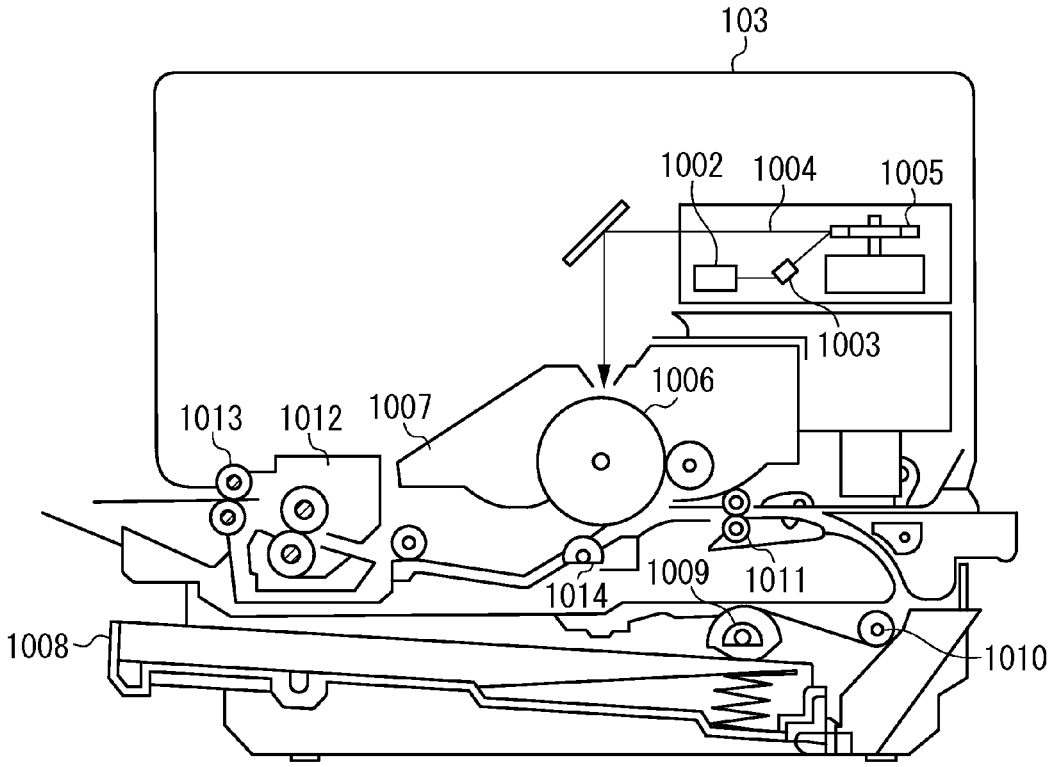
FIG. 10 is a cross-sectional view illustrating the printer.

FIG. 10 is a cross-sectional view illustrating the printer.

Referring to FIG. 10, a laser driver 1002 converts the print data to a video signal to be output.

A semiconductor laser 1003 emits a laser beam according to the video signal input from the laser driver 1002.

A laser beam 1004 is emitted from the semiconductor laser 1003.

A rotating polygon mirror 1005 scans the laser beam 1004 in a main scanning direction.

A photosensitive member 1006 receives the laser beam scanned in the main scanning direction by the rotating polygon mirror 1005 and is scan-exposed. As a result, an electrostatic latent image of the output image is formed on the photosensitive member 1006.

A developing unit 1007 develops the electrostatic latent image of the output image formed on the photosensitive member 1006. The output image is then transferred from the photosensitive member 1006 to the sheet.

A sheet cassette 1008 stores the sheets.

A feed roller 1009 feeds the sheet stored in the sheet cassette 1008.

Conveying rollers 1010 and 1011 convey the sheet fed by the feed roller 1009 to the photosensitive member 1006. The conveyance speed of the sheet is adjusted by controlling rotating speeds of the conveying rollers 1010 and 1011.

A fixing unit 1012 fixes the output image transferred to the sheet. The fixing unit 1012 includes a detection unit which measures temperature of a fixing roller and detects a temperature rise error when the temperature of the end portions stands at a predetermined value or higher.

A discharge roller 1013 discharges the sheet on which the output image has been fixed by the fixing unit 1012. A transfer roller 1014 applies the transfer voltage opposite to the toner and transfers the toner from the photosensitive member 1006 to the sheet. The transfer voltage is adjusted by controlling the voltage applied on the transfer roller 1014.

<Control Performed when Printing: The PC>

Figure 4:
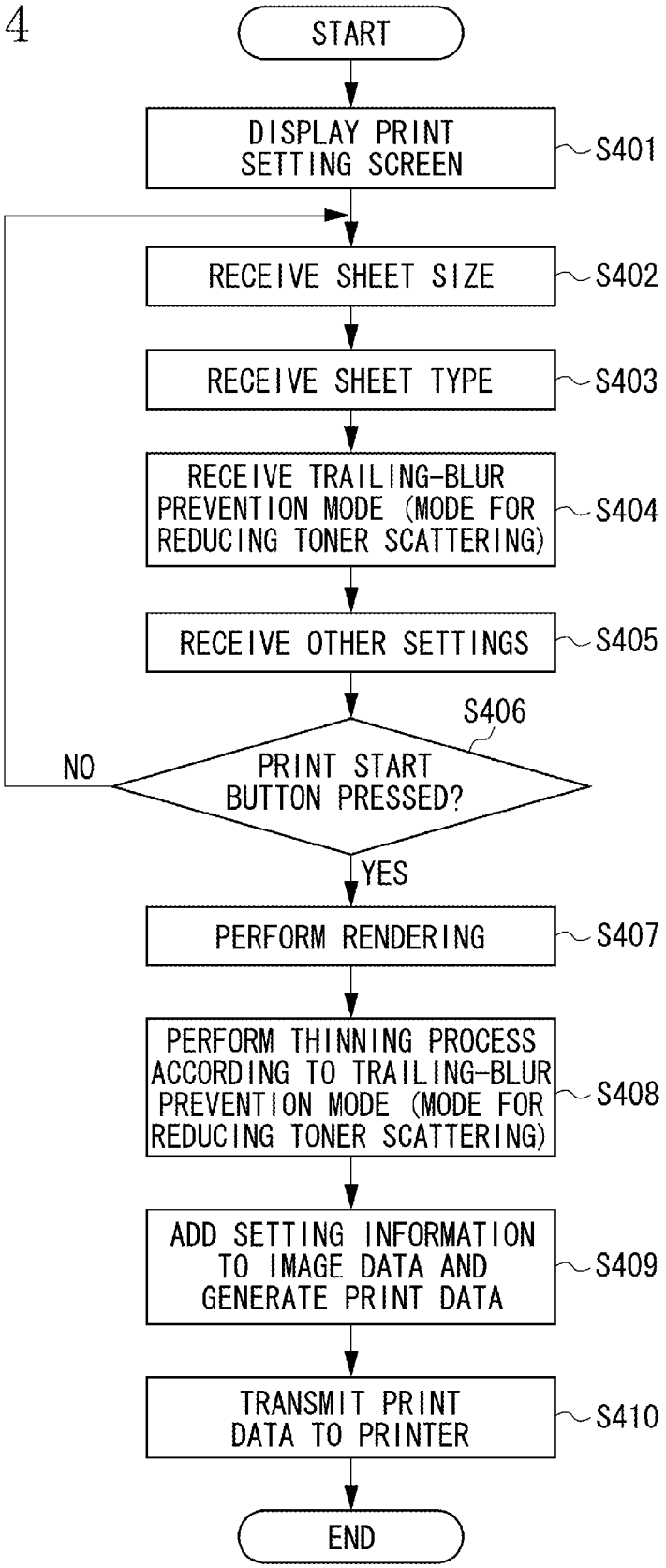
FIG. 4 is a flowchart illustrating a process performed by the PC when the system does printing.

FIG. 4 is a flowchart illustrating the process performed in the PC when the image forming system does printing.

The process illustrated in the flowchart of FIG. 4 is realized by the CPU 201 reading the program stored in the HDD 203 to the RAM 202 and executing the program.

Further, the process illustrated in the flowchart of FIG. 4 is started by activating the printer driver in a state where a file is opened by an application on the PC 102.

In step S401, the CPU 201 displays the print setting screen of the printer driver, via the display unit 210.

Figure 7:
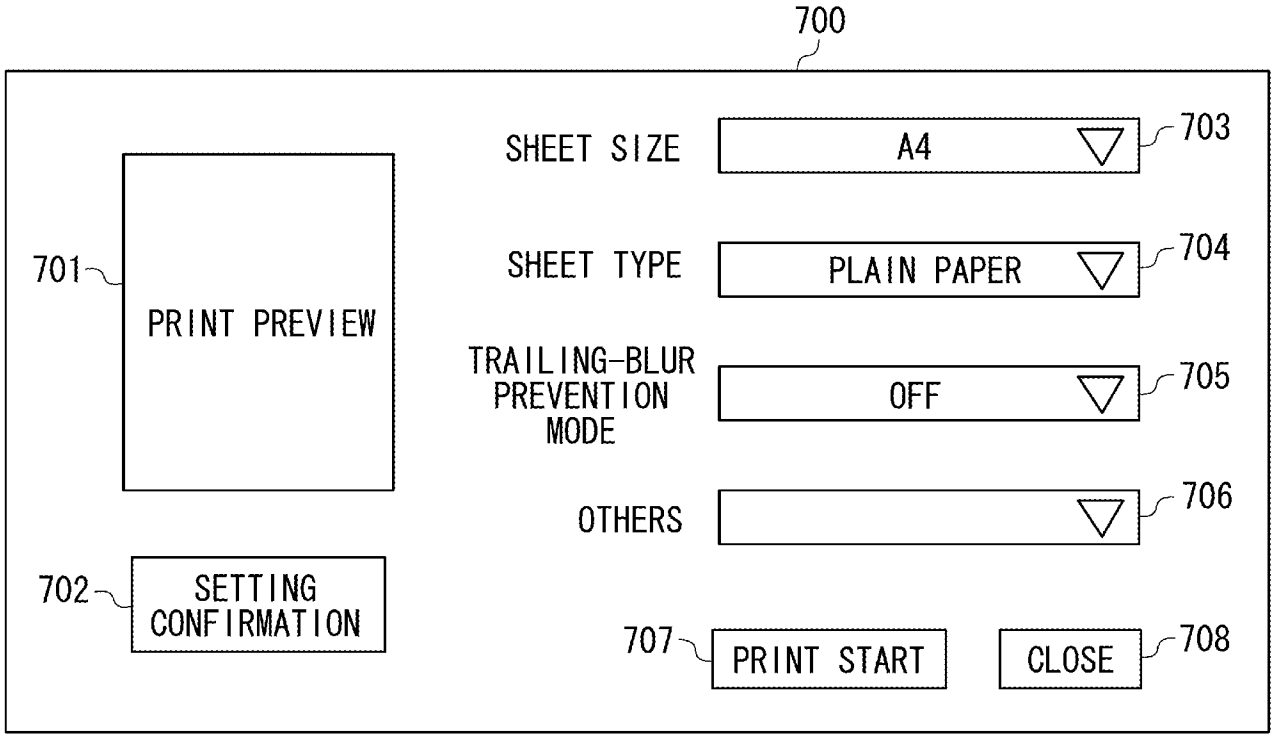
FIG. 7 illustrates a print setting screen of a printer driver.

FIG. 7 illustrates the print setting screen of the printer driver. Referring to FIG. 7, various print settings can be specified via a print setting screen 700 of the printer driver. A print preview area 701 displays a preview of an image obtainable when printing is performed according to current settings. If a setting confirmation button 702 is pressed, a dialog is opened, and a list of the current settings is displayed. A sheet size setting menu 703 is a menu for setting the sheet size by selecting from "A4", "Letter", "Legal", "B5", "A5", "postcard", "envelope", and the like.

A sheet type setting menu 704 is a menu for setting the sheet type by selecting from "plain paper", "thin paper", "overhead projection (OHP)", "cardboard", "postcard", "envelope", and the like. According to the present exemplary embodiment, the sheet type indicates the type of sheet according to a difference in grammage (i.e., weight per 1 $m^2$ of the sheet) of the sheet.

A tailing-blur prevention mode (i.e., a mode for reducing toner scattering) setting menu 705 is a menu for setting the tailing-blur prevention mode by selecting from "off", "mode A", "mode B", "mode C", "mode D", and the like. The tailing-blur prevention mode is used for determining whether a thinning pattern and a tailing-blur prevention command to be described below have been selected and issued. An other settings menu 706 is a menu for setting one-sided printing, two-sided printing, and a sheet feed stage.

If a print start button 707 is pressed, printing is started.

If a close button 708 is pressed, the printer driver print setting screen 700 is closed.

Returning to FIG. 4, in step S402, the CPU 201 receives via the operation unit 205 the sheet size selected by the user 101 from the sheet size setting menu 703.

In step S403, the CPU 201 receives via the operation unit 205 the sheet type selected by the user 101 from the sheet type setting menu 704.

In step S404, the CPU 201 receives via the operation unit 205 the tailing-blur prevention mode selected by the user 101 from the tailing-blur prevention mode setting menu 705. In step S405, the CPU 201 receives via the operation unit 205 the setting selected by the user 101 from the other settings menu 706.

In step S406, the CPU 201 determines whether the user 101 has pressed the print start button 707 via the operation unit 205. If the user has pressed the print start button 707 (YES in step S406), the process proceeds to step S407. If the user has not pressed the print start button 707 (NO in step S406), the process returns to step S402.

In step S407, the CPU 201 controls the RIP 313, performs rendering on the image of the file opened by the application, and generates the raster data.

In step S408, the CPU 201 controls the image processing unit 315 and executes the thinning process on the raster data generated in step S407 according to the tailing-blur prevention mode received in step S404.

Figure 8:
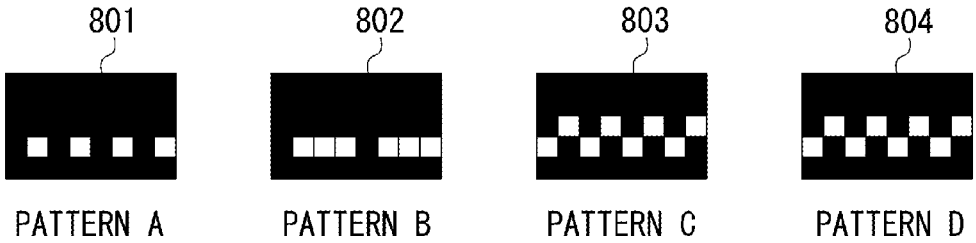
FIG. 8 illustrates thinning patterns according to a mode for reducing toner scattering.

FIG. 8 illustrates the thinning patterns according to the tailing-blur prevention modes.

If the tailing-blur prevention mode is off, the thinning process is not performed.

If the tailing-blur prevention mode is set to the mode A, the thinning process is performed using pattern A 801. A thinning amount of the pattern A 801 is the smallest among the thinning patterns. If the tailing-blur prevention mode is set to the mode A, the transfer voltage of the toner at the time of printing is a medium voltage as will be described below.

If the tailing-blur prevention mode is set to the mode B, the thinning process is performed using the pattern B 802. The thinning amount of the pattern B 802 is greater than that of the pattern A 801 and less than the pattern C 803 and the pattern D 804. If the tailing-blur prevention mode is set to the mode B, the transfer voltage of the toner at the time of printing is basically the high voltage as will be described below.

If the tailing-blur prevention mode is set to the mode C, the thinning process is performed using the pattern C 803. The thinning amount of pattern C 803 is the greatest among the thinning patterns. If the tailing-blur prevention mode is set to the mode C, the transfer voltage of the toner at the time of printing is the medium voltage as will be described below.

If the tailing-blur prevention mode is set to the mode D, the thinning process is performed using the pattern D 804. The thinning amount of the pattern D 804 is the greatest the same as the pattern C 803. If the tailing-blur prevention mode is set to the mode D, the transfer voltage of the toner at the time of printing is the high voltage as will be described below.

Returning to FIG. 4, in step S409, the CPU 201 adds setting information corresponding to the various settings received in steps S402 to S405 to the image data on which the thinning process has been performed in step S408. The CPU 201 thus generates the print data.

Figure 9:
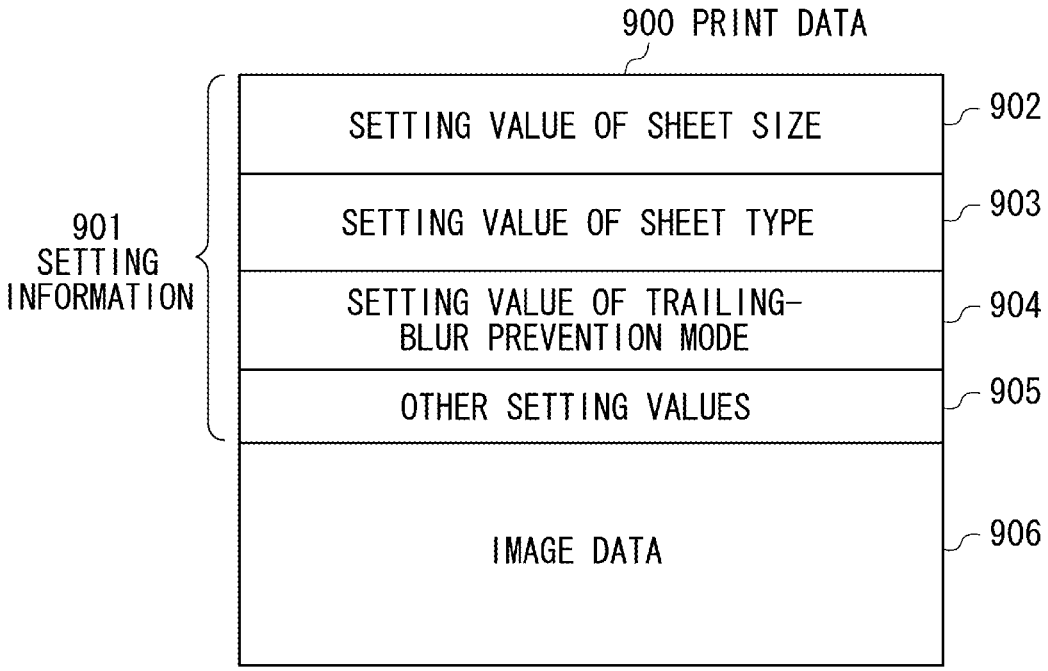
FIG. 9 illustrates a data configuration of print data.

FIG. 9 illustrates the data configuration of the print data.

Referring to FIG. 9, print data 900 can be divided broadly into information 901 and image data 906.

The setting information 901 includes a sheet size setting value 902, a sheet type setting value 903, a tailing-blur prevention mode setting value 904, and other setting values 905.

The sheet size setting value 902 is the information indicating the sheet size received in step S402.

The sheet type setting value 903 is the information indicating the sheet type received in step S403.

The tailing-blur prevention mode setting value 904 is the information indicating the tailing-blur prevention mode received in step S404.

The other setting values 905 is the information indicating the other settings received in step S405.

The image data 906 is the raster data obtained after performing the thinning process in step S408.

Returning to FIG. 4, in step S410, the CPU 201 transmits the print data 900 generated in step S409 to the printer 103 via the wired LAN I/F 207. The print data 900 may be transmitted via the wireless LAN I/F 206 or the USB I/F 208 instead of the wired LAN I/F 207.

<Control Performed when Printing: The Printer>

Figure 5:
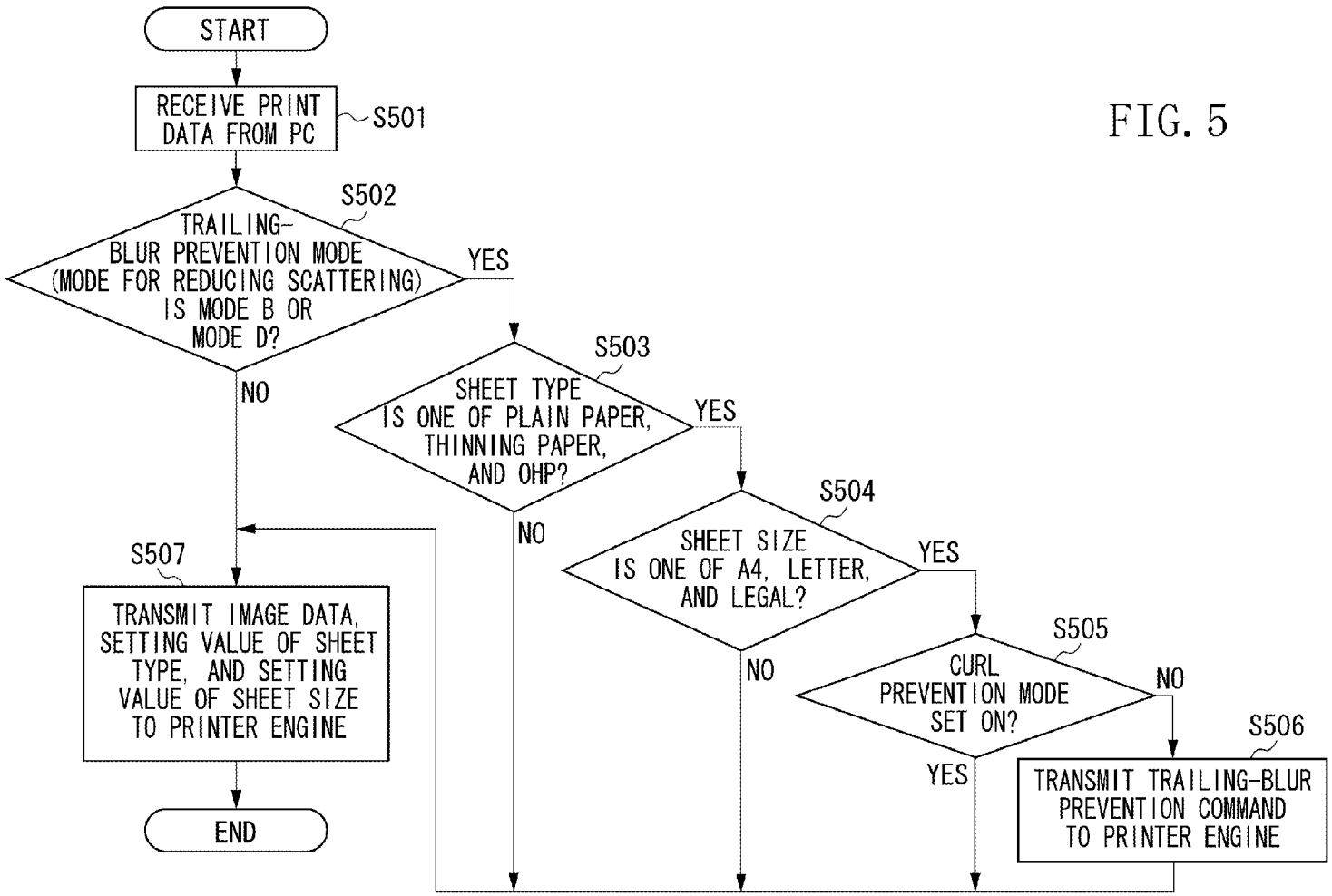
FIG. 5 is a flowchart illustrating a process performed by a controller in the printer when the system does printing.

FIG. 5 is a flowchart illustrating the process performed by the controller in the printer when the image forming system does printing. The process illustrated in the flowchart of FIG. 5 is realized by the CPU 301 reading the program stored in the Flash ROM 302 to the RAM 303 and executing the program.

In step S501, the CPU 301 receives via the wired LAN I/F 308 the print data 900 transmitted from the PC 102 in step S410. The print data 900 may be received via the wireless LAN I/F 307 or the USB I/F 310 instead of the wired LAN I/F 308.

In step S502, the CPU 301 refers to the tailing-blur prevention mode setting value 904 included in the print data 900 received in step S501 and determines whether the tailing-blur prevention mode is set to either of the mode B or the mode D. If the tailing-blur prevention mode is set to either of the mode B or the mode D (YES in step S502), the process proceeds to step S503. If the tailing-blur prevention mode is not set to either of the mode B or the mode D (NO in step S502), the process proceeds to step S507.

In step S503, the CPU 301 refers to the sheet type setting value 903 included in the print data received in step S501 and determines whether the sheet type is set to one of the plain paper, the thin paper, or the OHP. If the sheet type is set to one of the plain paper, the thin paper, or the OHP (YES in step S503), the process proceeds to step S504. If the sheet type is not set to any one of the plain paper, the thin paper, or the OHP (NO in step S503), the process proceeds to step S507.

In step S504, the CPU 301 refers to the sheet size setting value 902 included in the print data received in step S501 and determines whether the sheet size is set to one of A4, Letter, or Legal. If the sheet size is set to one of A4, Letter, or Legal (YES in step S504), the process proceeds to step S505. If the sheet size is not set to one of A4, Letter, or Legal (NO in step S504), the process proceeds to step S507.

In step S505, the CPU 301 refers to the setting value of a curl setting mode stored in NVMEM 304 and determines whether a curl prevention mode is set on. The curl prevention mode is the mode for preventing the sheet from curling by the heat or pressure when performing printing. An on/off setting value of the curl prevention mode is previously received via the operation unit 306 and stored in the NVMEM 304. If the curl prevention mode is on, the CPU 301 transmits via the printer I/F 314 a curl prevention command to the printer engine 318. If the curl prevention mode is on (YES in step S505), the process proceeds to step S507, and if the curl prevention mode is off (NO in step S505), the process proceeds to step S506.

In step S506, the CPU 301 transmits the tailing-blur prevention command to the printer engine 318 via the printer I/F 314.

In step 507, the CPU 301 transmits the image data 906, the sheet type setting value 903, and the sheet size setting value 902 included in the print data 900 received in step S501 to the printer engine 318 via the printer I/F 314. The data and the values may be transmitted via the wired LAN I/F 206 and the USB I/F 208 instead of the wired LAN I/F 207.

Figure 6:
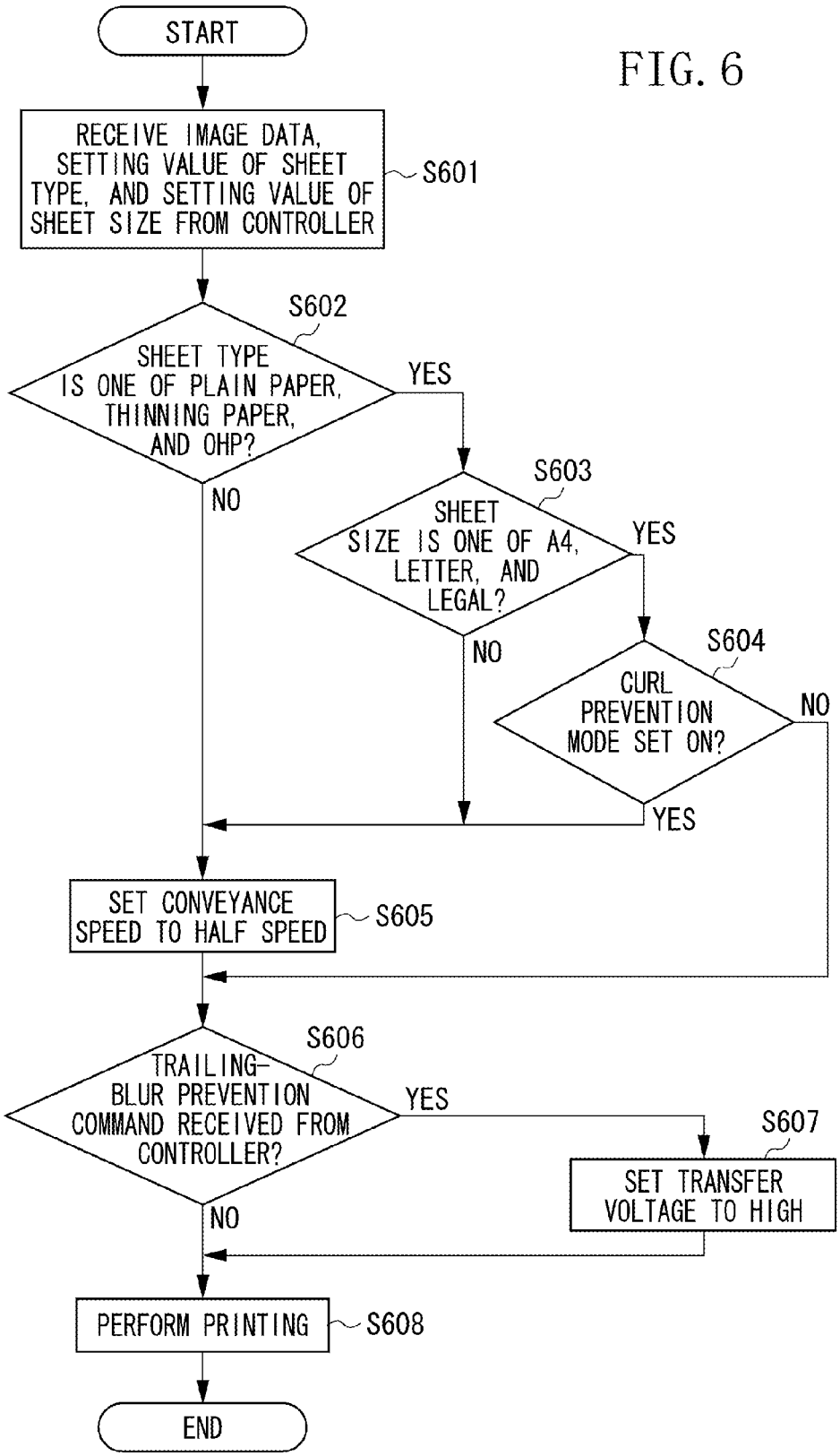
FIG. 6 is a flowchart illustrating a process performed by a printer engine in the printer when the system does printing.

FIG. 6 is a flowchart illustrating the process performed by the printer engine in the printer when the image forming system does printing.

In step S601, the printer engine 318 receives the image data 906, the sheet type setting value 903, and the sheet size setting value 902 transmitted from the controller 300 in step S507.

In step S602, the printer engine 318 refers to the sheet type setting value 903 received in step S601 and determines whether the sheet type is set to one of the plain paper, the thin paper, or the OHP. If the sheet type is set to one of the plain paper, the thin paper, or the OHP (YES in step S602), the process proceeds to step S603. If the sheet type is not set to any of the plain paper, the thin paper, or the OHP (NO in step S602), the process proceeds to step S605.

In step S603, the printer engine 318 refers to the sheet size setting value 902 received in step S601 and determines whether the sheet size is set to one of A4, Letter, or Legal. If the sheet size is set to one of A4, Letter, or Legal (YES in step S603), the process proceeds to step S604. If the sheet size is not set to any of A4, Letter, or Legal (NO in step S603), the process proceeds to step S605.

In step S604, the printer engine 318 confirms whether the curl prevention command has been received from the controller 300 and determines whether the curl prevention mode is on. If the curl prevention mode is on (YES in step S604), the process proceeds to step S605. If the curl prevention command is off (NO in step S604), the process proceeds to step S606.

In step S605, the printer engine 318 sets the conveyance speed of the sheet when performing printing at half of a full speed. The conveyance speed is set at the full speed in default and remains at the full speed unless step S605 is performed. Although the half speed of the conveyance speed is less than the full speed thereof, the conveyance speed may be set at a speed other than the half speed or the full speed as long as a similar relation is established.

In step S606, the printer engine 318 determines whether the tailing-blur prevention command transmitted from the controller 300 in step S506 has been received. If the tailing-blur prevention command has been received (YES in step S606), the process proceed to step S607. If the tailing-blur prevention command has not been received (NO in step S606), the process proceed to step S608.

In step S607, the printer engine 318 sets the toner transfer voltage when performing printing to the high voltage. The transfer voltage is set to the medium voltage in default and remains set to the medium voltage unless the process of step S607 is performed. Although the medium transfer voltage is less than the high transfer voltage, the transfer voltage other than the medium and high transfer voltages may be used as long as the similar relation is established.

In step S608, the printer engine 318 does printing (i.e., the image forming process) according to the conveyance speed and the transfer voltage set in steps S602 to S607 based on the image data 906, the sheet type setting value 903, and the sheet size setting value 902 received in step S601.

As described above, according to the first exemplary embodiment, if the predetermined tailing-blur prevention mode is set when performing printing, the toner transfer voltage is basically the high voltage. In contrast, if the conveyance speed of the sheet is set to the half speed, the transfer voltage of the toner (i.e., the recording material) is the medium voltage.

As a result, according to the first exemplary embodiment, in the case where the tailing-blur prevention mode is set, a ghost is prevented from occurring when the toner is transferred even if the conveyance speed of the sheet is set to the half speed.

A second exemplary embodiment will be described below. According to the first exemplary embodiment, the print setting, the rendering process, and the thinning process are performed in the PC.

In contrast, according to the second exemplary embodiment, one or more of the print setting, the rendering process, and the thinning process are performed in the printer.

In such a case, the corresponding process among the processes of steps S401 to S406 (i.e., the print setting), step S407 (i.e., the rendering process), and step S408 (i.e., the thinning process) illustrated in the flowchart of FIG. 4 (i.e., the control process performed by the PC) is performed before step S501 in the flowchart illustrated in FIG. 5 (i.e., the control process performed by the controller in the printer).

According to the second exemplary embodiment, a processing load on the PC can be reduced when performing the tailing-blur preventions as compared to the first exemplary embodiment.

A third exemplary embodiment will be described below. According to the first exemplary embodiment, the controller in the printer determines whether to issue the tailing-blur prevention command.

In contrast, according to the third exemplary embodiment, the PC or the printer engine in the printer determines whether to issue the tailing-blur prevention command.

In such a case, the processes of steps S502 to S506 (i.e., determination of whether to issue the tailing-blur prevention command) illustrated in the flowchart of FIG. 5 (i.e., the control process performed by the controller in the printer) are performed after step S408 illustrated in the flowchart of FIG. 4 (i.e., the control process performed by the PC) or step S601 in the flowchart illustrated in FIG. 6 (i.e., the control process performed by the printer engine in the printer).

According to the third exemplary embodiment, the processing load on the controller in the printer can be reduced when performing the tailing-blur preventions as compared to the first exemplary embodiment.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2014-055463 filed Mar. 18, 2014, which is hereby incorporated by reference herein in its entirety.

What is claimed is:

1. An image forming system comprising:

a first receiving unit configured to receive sheet settings;

a second receiving unit configured to receive a setting of a mode for reducing toner scattering in a fixing unit;

a first setting unit configured to set, according to sheet settings received by the first receiving unit, a conveyance speed of a sheet when performing an image forming process;

a second setting unit configured to set, according to a setting of a mode for reducing toner scattering received by the second receiving unit, a transfer voltage of a recording material when performing an image forming process; and an image forming unit configured to perform an image forming process according to sheet settings received by the first receiving unit, a conveyance speed set by the first setting unit, and a transfer voltage set by the second setting unit, wherein the second setting unit sets, in a case where the second receiving unit has received a mode for reducing toner scattering, a first transfer voltage when the first setting unit sets a first conveyance speed, and a second transfer voltage that is lower than the first transfer voltage when the first setting unit sets a second conveyance speed that is lower than the first conveyance speed.

2. The image forming system according to claim 1, wherein the second setting unit sets, in a case where the second receiving unit has received a second mode for reducing toner scattering, the second transfer voltage.

3. The image forming system according to claim 1, wherein the second setting unit sets, in a case where the second receiving unit has not received the mode for reducing toner scattering, the second transfer voltage.

4. The image forming system according to claim 1, wherein the second setting unit sets, in the case where the second receiving unit has received the mode for reducing toner scattering, the first transfer voltage when the first receiving unit has received a first sheet type and the second transfer voltage when the first receiving unit has received a second sheet type.

5. The image forming system according to claim 4, wherein the first sheet type is a plain paper, a thin paper, or an OHP.

6. The image forming system according to claim 1, wherein the second setting unit sets, in the case where the second receiving unit has received the mode for reducing toner scattering, the first transfer voltage when the first receiving unit has received a first sheet size and the second transfer voltage when the first receiving unit has received a second sheet size.

7. The image forming system according to claim 6, wherein the first sheet size is A4, Letter, or Legal.

8. The image forming system according to claim 1, wherein the second setting unit sets, in the case where the second receiving unit has received the mode for reducing toner scattering, the first transfer voltage when a curl prevention mode for reducing curling of a sheet is not set and the second transfer voltage when the curl prevention mode is set.

9. The image forming system according to claim 1, wherein the first setting unit sets the first conveyance speed when the first receiving unit has received a first sheet type and the second conveyance speed when the first receiving unit has received a second sheet type.

10. The image forming system according to claim 1, wherein the first setting unit sets the first conveyance speed when the first receiving unit has received a first sheet size and the second conveyance speed when the first receiving unit has received a second sheet size.

11. The image forming system according to claim 1, wherein the first setting unit sets the first conveyance speed when a curl prevention mode for reducing curling of a sheet is not set and the second conveyance speed when the curl prevention mode is set.

12. The image forming system according to claim 1, further comprising a thinning unit configured to perform, according to a setting of a mode for reducing toner scattering received by the second receiving unit, a thinning process on image data used when executing an image forming process.

13. The image forming system according to claim 1, wherein the image forming system includes an information processing apparatus and an image forming apparatus, wherein the information processing apparatus includes the first receiving unit and the second receiving unit, and wherein the image forming apparatus includes the first setting unit, the second setting unit, and the image forming unit.

14. A control method of an image forming system comprising:

receiving sheet settings;

receiving a setting of a mode for reducing toner scattering in a fixing unit;

setting, according to the received sheet settings, a conveyance speed of a sheet when performing an image forming process;

setting, according to the received setting of a mode for reducing toner scattering, a transfer voltage of a recording material when performing an image forming process; and performing an image forming process according to the received sheet settings, the set conveyance speed, and the set transfer voltage, wherein, when setting the transfer voltage, in a case where a mode for reducing toner scattering has been received, a first transfer voltage is set when a first conveyance speed is set and a second transfer voltage that is lower than the first transfer voltage is set when a second conveyance speed that is lower than the first conveyance speed is set.

15. A non-transitory computer-readable storage medium storing a program that causes a computer to execute a control method of an image forming system, the control method comprising:

receiving sheet settings;

receiving a setting of a mode for reducing toner scattering in a fixing unit;

setting, according to the received sheet settings, a conveyance speed of a sheet when performing an image forming process;

setting, according to the received setting of a mode for reducing toner scattering, a transfer voltage of a recording material when performing an image forming process; and performing an image forming process according to the received sheet settings, the set conveyance speed, and the set transfer voltage, wherein, when setting the transfer voltage, in a case where a mode for reducing toner scattering has been received, a first transfer voltage is set when a first conveyance speed is set and a second transfer voltage that is lower than the first transfer voltage is set when a second conveyance speed that is lower than the first conveyance speed is set.

* * * * *